US010322499B2

(12) United States Patent
Mikkelsen

(10) Patent No.: US 10,322,499 B2
(45) Date of Patent: Jun. 18, 2019

(54) SCREWING DEVICE

(71) Applicant: Lars Mikkelsen, Horsens (DK)

(72) Inventor: Lars Mikkelsen, Horsens (DK)

( * ) Notice: Subject to any disclaimer, the term of this patent is extended or adjusted under 35 U.S.C. 154(b) by 0 days.

(21) Appl. No.: 15/739,896

(22) PCT Filed: Jun. 28, 2016

(86) PCT No.: PCT/DK2016/050225
§ 371 (c)(1),
(2) Date: Dec. 26, 2017

(87) PCT Pub. No.: WO2017/000962
PCT Pub. Date: Jan. 5, 2017

(65) Prior Publication Data

US 2018/0361546 A1 Dec. 20, 2018

(30) Foreign Application Priority Data

Jul. 2, 2015 (DK) ..... 2015 70428

(51) Int. Cl.

| | |
|---|---|
| ***B25B 23/00*** | (2006.01) |
| ***B25B 23/04*** | (2006.01) |
| ***E04F 15/02*** | (2006.01) |
| ***E04F 21/22*** | (2006.01) |
| *E04F 15/22* | (2006.01) |

(52) U.S. Cl.
CPC ..... *B25B 23/005* (2013.01); *B25B 23/045* (2013.01); *E04F 15/02183* (2013.01); *E04F 21/22* (2013.01); *E04F 15/22* (2013.01); *E04F 2015/0205* (2013.01)

(58) Field of Classification Search
CPC ..... B25B 23/005; B25B 23/045; E04F 15/02183; E04F 15/22; E04F 21/22
USPC ..... 81/451, 44
See application file for complete search history.

(56) References Cited

U.S. PATENT DOCUMENTS

| | | | | |
|---|---|---|---|---|
| 5,699,704 | A | 12/1997 | Habermehl | |
| 9,802,300 | B2 * | 10/2017 | Vandenberg | B25B 21/002 |
| 2010/0083610 | A1 * | 4/2010 | King | B25B 15/001 52/749.1 |

(Continued)

FOREIGN PATENT DOCUMENTS

| | | | |
|---|---|---|---|
| DE | 10 2008 018 072 | B3 | 3/2009 |
| EP | 2 517 834 | A2 | 10/2012 |

OTHER PUBLICATIONS

International Search Report and Written Opinion, Appl. No. PCT/DK2016/050225, dated Nov. 3, 2016.

*Primary Examiner* — Hadi Shakeri
(74) *Attorney, Agent, or Firm* — Winston & Strawn LLP

(57) ABSTRACT

A screwing device, which serves for screwing boards (2) onto underlying crossbeams (3) in such a way that the screws are screwed tilted in from the edges (5) of the boards (2). The screwing device includes a base (7) with an oblong foot (8) which in use stands on the upper side of the boards (2), two arms (9) extending tilted out from each their end of the foot (8), and two opposite screw drivers (10), which are mounted on each their arm (9) and each is arranged with means for conveying a disposable belt (34) of releasable screws (6) and for stepwise screwing in screws (6) from the belt (34). With the present invention, the components of a terrace can be screwed faster together than hitherto known, and at the same time the terrace obtains optimal strength.

8 Claims, 3 Drawing Sheets

(56) References Cited

U.S. PATENT DOCUMENTS

2013/0276591 A1 10/2013 Vandenberg

* cited by examiner

SCREWING DEVICE

This application is a 371 filing of International Patent Application PCT/DK2016/050225 filed Jun. 28, 2016, which claims the benefit of Danish application no. PA 2015 70428 filed on Jul. 2, 2015.

BACKGROUND

The invention relates to a screwing device for screwing boards on underlying crossbeams in such a way as to screw the screws tilted in from the edges of the boards.

Boards on underlying crossbeams are for example used for terraces. Between the boards there will normally be a space.

The screws can be screwed in by means of a common hand operated screwdriver. That is however a slow and cumbersome process, especially when concerning a larger numbers of boards.

Therefore, in the course of time, screwdrivers have been developed, which are motorized and arranged for stepwise conveying disposable belts with releasable screws. Thereby is obtained a significant easement of the former operation of manually rotating a common screwdriver and holding a screw into position during the process of screwing in the screws, whereby also the operation can be carried out much faster.

A screwdriver of this kind is known from the U.S. Pat. No. 5,699,704 B1. This known screwdriver is held manually into position during work. That implies, that the specific angle, that the screws need to form in relation to the edges of the boards for being able to obtain the required strength of for example a terrace, cannot be complied with in practice. The operation can moreover only be carried out from one edge at a time.

SUMMARY OF THE INVENTION

The drawbacks, which the known technique thus has, are according to the invention remedied by, in a first aspect of the invention providing a screwing device of the kind mentioned in the opening paragraph, by means of which the operator without any trouble would be able to screw boards on underlying beams by means of screws each forming exactly that specific angle with an edge of a board which is necessary for being able to obtain the required strength of for example a terrace, in another aspect of the invention providing a screwing device of the kind mentioned in the opening paragraph, by means of which the operator is able to screw boards on underlying beams without extra trouble and time consumption, in a third aspect of the invention providing a screwing device of the kind mentioned in the opening paragraph, by means of which the operator much faster than hitherto known can screw boards on underlying beams, in a fourth aspect of the invention providing a screwing device of the kind mentioned in the opening paragraph, by means of which boards can be fasten with screws on underlying beams without leaving visible screw heads, in a fifth aspect of the invention providing a screwing device of the kind mentioned in the opening paragraph, which screwing device is more ergonomic to operate than the known screwing devices.

These and further aspects are according to the invention obtained in that the screwing device of the invention comprises a base formed with an oblong foot, which in use stands on the upper side of the boards, two arms extending tilted out from each their end of the foot, and two opposite screw drivers, which are mounted on each their arm and each is arranged with means for conveying a disposable belt of releasable screws and for stepwise screwing in screws from the belt.

This combination of features implies that for example the components of a terrace can be screwed faster together than hitherto and that the terrace obtains optimal strength.

According to the invention the foot may consist of a left and right foot part separated by a space and also of an element, like a bolt, that extends across the space and connects the two foot parts. In addition the element may have a left part, which is adjustable axially as the left part is disposed slideable in the left foot part, and a right part which is slideable disposed in the right foot part, so that the foot can be adjusted in the longitudinal direction, and thereby be adapted to different structures with different width of boards, and thus to varying distances between the spaces and boards. An example of such a structure is a terrace, but the invention is applicable to any structure in which a plurality of side-by-side-laid oblong objects are to be fastened by screws to a substantially perpendicularly to the oblong objects arranged underlying other object, or several spaced apart underlying objects.

The above adjustment may in a preferred embodiment of the invention advantageously be obtained by forming a chamber in the right foot part, wherein the right part of the element, for example the bolt, extends into with a head bearing against the right end wall of the chamber, while a compression spring extends between the head of the bolt and the left end wall of the chamber, at the same time as the left foot part is arranged with a longitudinal bore into which the left bolt part extends, whereby the foot easily, quickly and safely can be adjusted so that it will fit to varying widths of the boards and varying spaces between the boards. Thus the left foot part is adapted for tightening the left bolt part of the bolt in a selected position in the bore.

On the underside of each of the two foot parts of the foot may according to the invention also be arranged a transverse rib to effectively setting the position of the screwing device in use.

The undersides of the foot parts thus advantageously can be formed with each their transverse rib having a height equal to or less than the thickness of a board and a width equal to or narrower than the width of the space between two boards, and wherein the distance between the inner sides of the ribs of the two foot parts corresponds to the width of a board when the foot parts are pulled sufficiently apart from each other during overcoming the compressive force of the compression spring of the right foot part, and the left bolt part is tightened in the previously selected position in the bore of the left foot part.

According to the present invention a rod may be secured on the side of the left foot part at a distance above the underside for by means of for example a foot being loaded in such a way that the distance between the ribs is increased sufficiently to entirely or partly being able to relieve the pressure, which is generated by the compression spring and is exerted by the ribs on the edges of the boards. The screwing device can then easily and without any effort be pulled up of the spaces between the boards so that it is ready to be used for the next operation.

At least the upper portion of each of the arms of the base may expediently be divided into two pieces by a slot, that has the same or greater width than the diameter of a screw, and a bore having the same or a larger diameter than the head of the screw may extend through the slot and at least partly through the rib for guiding the screw into position.

The screws of the screwing device, which are relatively long, are usually formed with right-hand thread for screwing in the screws. According to the invention the screws also can be provided with an upper left-hand thread for successively removing the chips that are formed when screwing in a screw. Thereby is obtained the significant advantage of avoiding that chips stuffs up around the screw to make it more or less difficult to screw in the screw.

BRIEF DESCRIPTION OF THE DRAWINGS

The invention will be explained in greater details below, giving further advantageous features and technical effects and describing advantageous embodiments with reference to the drawing, in which.

DETAILED DESCRIPTION OF THE INVENTION

Figure 1:
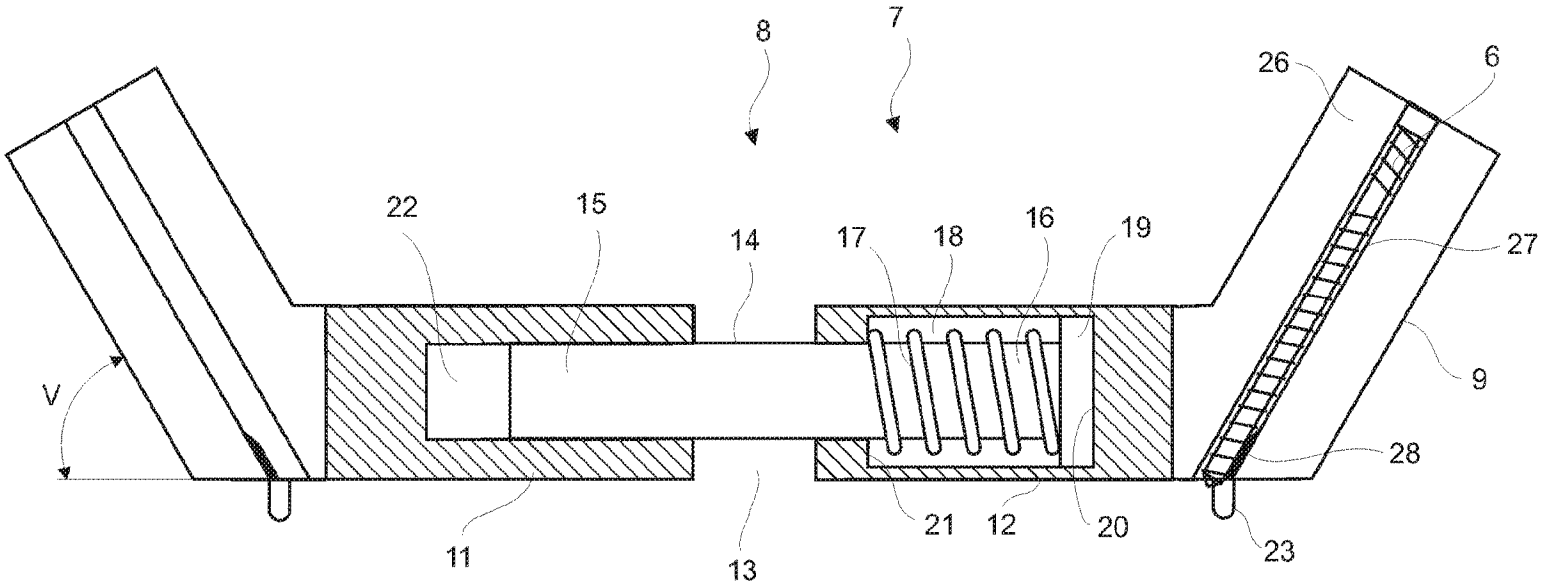
FIG. 1 is a longitudinal sectional view of the base according to the invention, seen from the side.

Below it is assumed that the screwing device 30 according to the invention is used for screwing together the terrace 1 shown in FIG. 3. The terrace consists of a plurality of boards 2 which are fastened by screws to a plurality of underlying crossbeams 3. The screwing device can however be used for assambling other kinds of similar structures, such as plank floors, grid floors, garden tables, etc., and the application in connection with a terrace is only given as an example. Assambling of smaller items of juxtaposed boards crosswise side-by-side-placed battens is a further option.

Terraces are often placed outdoors in places where they are exposed to rain and changing temperatures. The boards 2 therefore are placed for example with mutually space 4 in-between.

Figure 4:
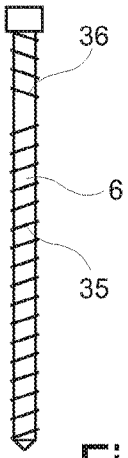
FIG. 4 shows a screw according to the invention, seen in an enlarged scale.

The screwing device 30 according to the invention serves for quickly and easely screwing boards 2 on crossbeams 3 by means of for example the screws 6 shown in FIG. 4, which screws are screwed tilted into the edges 5 of the boards 2 keeping a specific angle V, which each screw has to form with the edge 5 in question for ensuring the required strength of the finished terrace 1.

Figure 2:
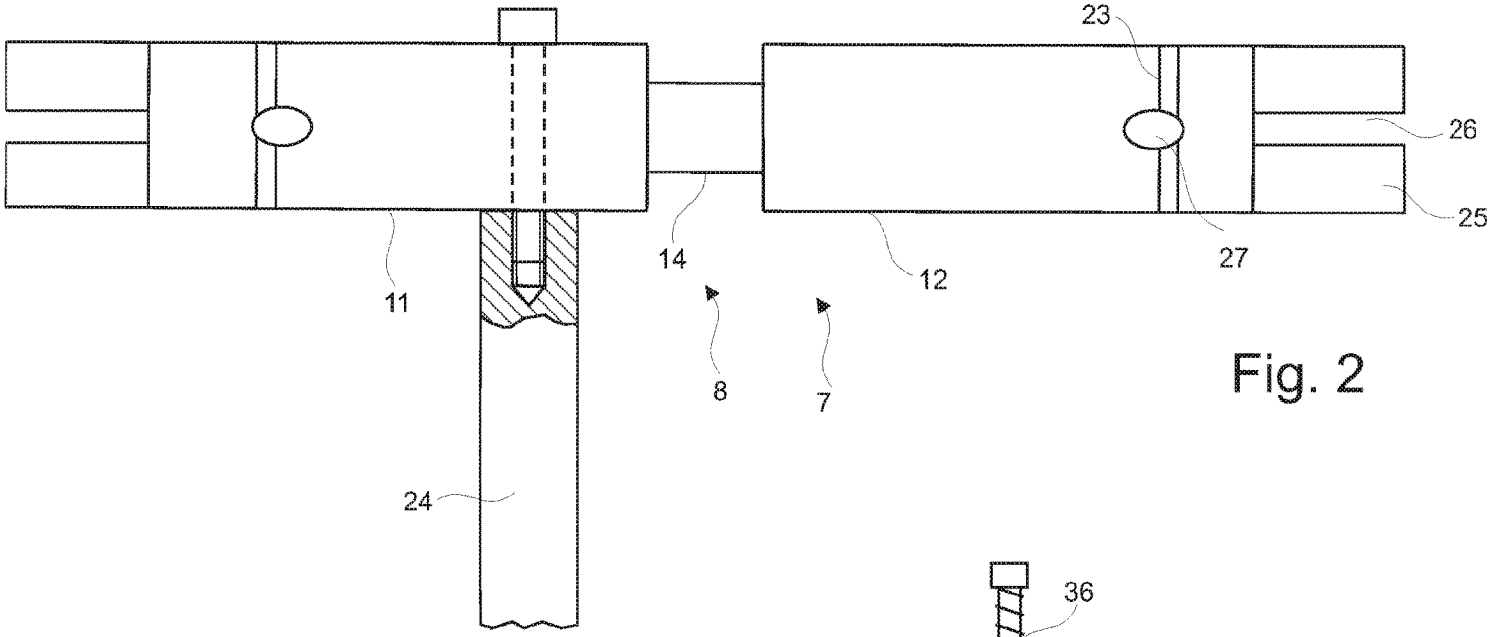
FIG. 2 shows the base according to the invention, seen from below.

These advantages are achieved by means of the base 7, which in FIG. 1 is seen in a longitudinal section from the side and in FIG. 2 is seen from below.

More particularly is the base 7 made of an elongated foot 8 and two arms 9 which projects tilted, out from the opposite ends of the base 8 at the same angle V to the foot which the screws have to form with the edges 5 of the boards.

Figure 3:
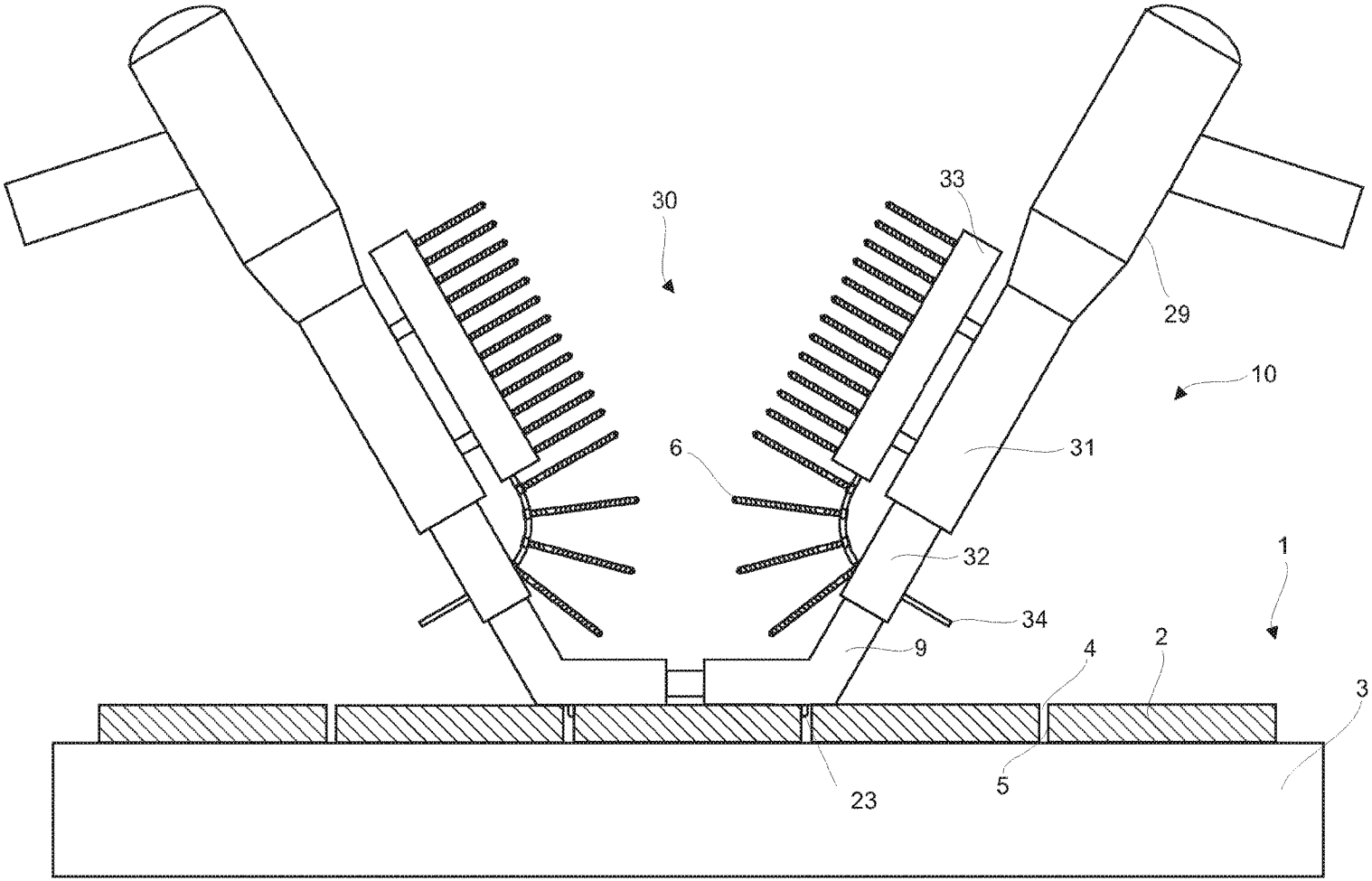
FIG. 3 is a lateral view of the base according to the invention mounted with two opposite screw drivers.

FIG. 3 shows that the foot 8 in use is standing on the upper side of the boards 2 and that two opposite screw drivers 10 are mounted on each their arm 9. The function and co-operation of screw drivers 10 with the base 7 will be described in more detail later.

The foot 8 is composed of a left and right foot part 11,12 separated by a space 13 and also of a bolt 14 extending across the space and connecting the two foot parts 11,12. The bolt 14 may have a circular or a polygonal cross section. In the present case the cross section is rectangular.

The bolt 14 has a left part 15 which slideable is disposed in the left foot part 11 and a right part 16 which slideable is disposed in the right foot part 12. The left part of the bolt can be locked in a selected position in the left foot part while the position of the right part is determined by the spring resistance of a compression spring 17.

In the right foot part 12 is formed a chamber 18 into which the right part 16 of the bolt 14 extends with a head 19 bearing against the right end wall 20 of the chamber 18, while the compression spring 17 extends between the bolt head 19 and the left end wall 21 of the chamber 18. In the left foot part 11 is moreover arranged a longitudinal bore 22 into which the left bolt part 15 extends.

On the underside of each of the two foot parts 11,12 of the foot 8 is arranged a transverse rib 23 which is smaller than the space 4 between two boards. The distance between the opposite inner sides of the two ribs corresponds in the main to or is initially a little smaller than the width of a board 2.

A protruding rod 24 is furthermore secured on one side of the left foot part 11 at a distance above the underside of the foot 8. The purpose of this rod 24 will be more explained in more details later.

As shown in FIG. 2 is each of the arms 9 of the base 7 divided into two halfs by means of a slot 26 that has the same or a little larger width than the diameter of a screw 6. The slot 26 appears moreover in FIG. 1 as that part of the arm 9, which is not hatched.

A bore 27 with the same or a little larger diameter than a screw head extends, as shown in FIG. 1, through the arm 9, the slot 26, and at least partly through the rib 23.

The bore 27 is like the arm 9 divided in two halfs by means of the slot 26 and forms the same angle V to the foot 8 as the arms 9 forms to the foot.

Owing to the presence of the slot 26 a screw 6 can be pivotted sideways into the bore 27 which bore subsequently is guiding the screw 6 when it is screwed into the edge 5 of a board 2 under the angle V.

Since the screw has a smaller diameter than the head of the screw and thereby of the bore, the screw would tend to turn downwards against the underside of the bore around the head of the screw whereby it would be more or less difficult to fasten a screw in the edge of a board, and the required angle V to the edge could not be complied with securely.

At the bottom of the bore is therefore placed a support to keep the screw in position during the operation of screwing in the screw.

The screwing device 30 is in FIG. 3 standing on the terrace 1 with the ribs 23 placed down in the spaces 4 on the sides of a board 2. The inner sides of the ribs are bearing against the edges 5 of the board influenced by the compression spring 17 with a force corresponding in the main to the spring resistance of the compression spring. The screwing device is ready to be used.

The use takes place by activating two in itself known screwdrivers 10, which are facing each other and are placed on each their arm 9.

Each of these screwdrivers 10 comprises a boring machine 29 placed on an upper house 31, which slideable between an upper and lower position is placed on a lower house 32, which again is fastened on one of the arms 9 of the foot 8.

The upper house 31 is mounted with a guidance 33 for a disposable belt 34 with releasable screws 6. The lower house 32 has moreover a device (not shown) for stepwise conveying the disposable belt.

Then the belt 34 is conveyed in a curve into the lower house 32 via a slot (not shown), which is a continuation of the slot 26 in the arm 9 shown in FIGS. 1 and 2. Said slots permit that an upper part of the screw 6 is turned into the lower house 32 simultaneous with the travelling of the belt, and that a lower part simultaneously is turned into the boring 27 of the arm 9 in that way, which previously is described with reference to FIG. 1 The empty disposable belt 34 is conveyed out on the opposite side.

The conveying is stopped when the disposable belt has brought a screw in position for being screwed in, after which the operator (not shown) can screw the screw 6 into the edge 5 of a board 2 by means of the boring machine 29 and the spindle of this (not shown).

In the houses 31 and 32 there is provided a compression spring (not shown) for pressing the upper house 31 up into its upper position when the screwing device 30 is not used.

When a screw is going to be screwed in, the operator is manually pressing, while overcoming the spring resistance of the compression spring of the houses, the upper house downwards towards its lower position, while the boring machine is screwing the screw home.

Finally the operator allows the compression spring press the upper house backwards again into its upper position, so that the screwing device 30 is ready for a new operating of screwing in a screw.

As it appears the screwing device according to the invention is screwing in two screws at the same time, and that is twice as many as the known screwdrivers are capable of doing. Therefore the job of assembling a terrace by means of screws can be carried out twice as fast as hitherto known when the screwing device according to the invention is being used.

Another essential advantage consists in the fact that the screwing device according to the invention automatically ensures that the screws always will form that angle V to the edges of the boards which is required for being able to achieve the required strength of the finished terrace. A further advantage is that two screws always will be placed opposite each other.

It is above supposed that the inner sides of the ribs are bearing against the edges of the board. Each board does however not has exactly the same width in the longitudinal direction and neither do the different boards all have exactly the same width. To this must be added that the boards easily can come to lie skew when being laid. The screwing device according to the invention therefore is able to screw screws into a terrace, where the width of space between the boards is varying.

That is according to the invention obtained by locking the left part 15 of the bolt 14 in den longitudinal bore 22 of the left foot part 11 in a position, in which the distance between the inner sides of the ribs 23 is a little smaller—for example some mm—than the width of a board 2, and subsequently pulling the two foot parts 11,12 from each other while overcoming the spring resistance of the compression spring 17 until the ribs 23 drops down into the two spaces 5, which exists at each board 2.

The ribs now are interlocked in their spaces influenced by the spring resistance of the compression spring 17, which spring resistance effectively ensures that the ribs are not jumping up of the spaces during the work so that the screws would be screwed incorrectly in. On the other hand it will be difficult to pull up the rib of the spaces each time changing to a new operation.

This problem can however be solved by means of the protruding rod 24 shown in FIG. 2, which rod is secured a distance above the underside of the foot 8 on one side of the left foot part 11. When treading on the rod in a given way the rod would act as a pedal pulling the ribs into the opposite direction of the spring resistance, so that the ribs not any longer can be interlocked in the spaces.

The screwing device can then easily and without any effort be pulled up the spaces so that it just like that can be used for the next operation.

The utilized screws are relatively long because they initially need to extend through the board and then need to reach sufficiently far into the underlying crossbeam for securing that the terrace achieves the required strength. But during fastening the screws in the woos of the terrace chips are continuously produced, which chips gradually are stuffing up so much around the long screw that the screw not or only with difficulty can be screwed further in by means of the spindle of the boring machine.

The screws 6 are therefore advantageously formed with a right hand thread 35 at the lower part of the screw and a left hand thread 36 at an upper part of the screw. The right hand thread 35 serves for screwing in the screw and the left hand thread 36 for successively removing the resulting chips so that they do not stuff up around the screw.

What is claimed is:

1. Screwing device (30) for screwing boards (2) on underlying crossbeams (3) in such a way, that the screws are screwed tilted in from the edges (5) of the boards (2), comprising:

a base (7) with an oblong foot (8) standing in use on the upper side of the boards (2), two arms (9) extending tilted out from each their end of the foot (8), and two opposite screw drivers (10) which are mounted on each their arm (9) and each is arranged with means for conveying a disposable belt (34) of releasable screws (6) and for stepwise screwing in screws (6) from the belt (34);

wherein the foot (8) comprises a left and right foot part (11,12) separated by a space (13), and of an element extending across the space and connecting the two foot parts (11,12);

wherein the element is a bolt (14) having a left part (15) which is disposed axially adjustable in the left foot part (11), and a right part (16), which is slideable disposed in the right foot part (12) influenced by a compression spring (17).

2. Screwing device (30) according to claim 1, wherein a chamber (18) is formed in the right foot part (12), that the right part (16) of the bolt (14) is extending into this chamber (18) with a head (19) bearing against the right end wall (20) of the chamber (18), and that the compression spring (17) is placed between the head (19) of the bolt (14) and the left end wall (21) of the chamber (18).

3. Screwing device (30) according to claim 1, wherein the left foot part (11) is formed with a longitudinal bore (22), that the left part (15) of the bolt (14) is extending into this bore (22), and that the left foot part (11) is adapted to tightening the left part (15) of the bolt (14) in a selected position in the bore (22).

4. Screwing device (30) according to claim 3, wherein the underside of each of the two foot parts (11,12) of the foot (8) is formed with a transverse rib (23) that has a height equal to or less than the thickness of a board (2) and a width equal to or narrower than the width of the space (4) between two boards (2), and that the distance between the inner sides of the ribs (23) on the two foot parts corresponds to the width of a board (2) when the foot parts (11,12) are pulled sufficiently far apart from each other during overcoming the compressive force of the compression spring (17) of the right foot part (12), and the left part (15) of the bolt (14) is tightened in the previously selected position in the bore (22) of the left foot part (11).

5. Screwing device (30) according to claim 4, wherein at least an upper portion of each of the arms (8) of the base (7) is divided into two pieces by a slot (26) having the same or a greater width than the diameter of a screw (6), and that a bore (27) having the same or a larger diameter than the head of the screw (6) is extending through the slot (26) and at least partly through the rib (23).

6. Screwing device (30) according to claim 5, wherein a support (28) is placed at the bottom of each bore (27) to keep a screw (6) in position during the operation of screwing in the screw.

7. Screwing device (30) according to claim 1, wherein a protruding rod (24) is secured at a distance above the underside of the foot (8) on one side of the left foot part (11).

8. Screwing device (30) according to claim 1, wherein the screws (6) have a right-hand thread (35) at a lower part and a left-hand thread (36) at a top part.

* * * * *